United States Patent [19]

Toyama

[11] 4,182,293

[45] Jan. 8, 1980

[54] EXHAUST GAS RECIRCULATION SYSTEM FOR AN INTERNAL COMBUSTION ENGINE

[75] Inventor: Noboru Toyama, Susono, Japan

[73] Assignee: Toyota Jidosha Kogyo Kabushiki Kaisha, Toyota

[21] Appl. No.: 897,869

[22] Filed: Apr. 19, 1978

[30] Foreign Application Priority Data

Dec. 29, 1977 [JP] Japan ..... 52/159302

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,802,402 | 4/1974 | Swatman | 123/119 A |
| 3,930,475 | 1/1976 | Lewis et al. | 123/119 A |
| 4,031,871 | 6/1977 | Hamanishi | 123/119 A |
| 4,041,915 | 8/1977 | Konishi | 123/119 A |
| 4,041,917 | 8/1977 | Suzuki | 123/119 A |
| 4,069,797 | 1/1978 | Nohira et al. | 123/119 A |
| 4,106,452 | 8/1978 | Mizutani | 123/119 A |
| 4,111,172 | 9/1978 | Nishizawa et al. | 123/119 A |

*Primary Examiner*—Wendell E. Burns

*Attorney, Agent, or Firm*—Stevens, Davis, Miller & Mosher

[57] ABSTRACT

An exhaust gas recirculation system for an internal combustion engine, having an exhaust gas recirculation control valve of the diaphragm type which controls the opening of an exhaust gas recirculation passage and is actuated by intake vacuum of the engine modified by a vacuum control valve which in turn is actuated by the pressure of exhaust gases in the exhaust gas recirculation passage controlled by the exhaust gas recirculation control valve, the system further including a relief valve which opens a diaphragm chamber of the exhaust gas recirculation control valve to the atmosphere when the engine is decelerated so that the exhaust gas recirculation control valve immediately closes the exhaust gas recirculation passage when the engine is decelerated.

7 Claims, 3 Drawing Figures

EXHAUST GAS RECIRCULATION SYSTEM FOR AN INTERNAL COMBUSTION ENGINE

BACKGROUND OF THE INVENTION

The present invention relates to an exhaust gas recirculation system for an internal combustion engine for a vehicle such as an automobile, and, more particularly, to an exhaust gas recirculation system of the back pressure control type.

An exhaust gas recirculation system of the back pressure type, which is known as a system of exhaust gas recirculation for an internal combustion engine, generally comprises an exhaust gas recirculation control valve provided at a middle portion of a recirculation passage which recirculates a part of exhaust gases from the exhaust passage to the intake passage of an engine, said control valve having a diaphragm chamber and being adapted to increase its opening in accordance with increase of vacuum supplied to said diaphragm chamber, a vacuum port provided in the intake passage so as to be located upstream of a throttle valve incorporated in the intake passage when it is fully closed and so as to be located downstream of said throttle valve when it is opened beyond a predetermined opening, and a vacuum control valve provided at a middle portion of a vacuum passage which connects said vacuum port and said diaphragm chamber of said exhaust gas recirculation control valve and being adapted to control the vacuum conducted through said vacuum passage in accordance with the pressure of exhaust gases in the recirculation passage, wherein the exhaust gas recirculation control valve is operated by the vacuum which is supplied from said vacuum port and controlled by said vacuum control valve in accordance with the pressure of exhaust gases in the recirculation passage so that the exhaust gas recirculation ratio, i.e. the ratio of flow of exhaust gases to that of intake air, is maintained substantially at a constant value over a wide range of operation of the engine.

However, in the conventional exhaust gas recirculation system of the back pressure type having the above-mentioned structure, since the exhaust gas recirculation control valve is operated by the vacuum controlled in accordance with the pressure of exhaust gases in the recirculation passage, there occurs a time delay from the instant when the flow of intake air is changed to the instant when the exhaust gas recirculation control valve is operated to meet with the change of intake air flow due to the time required for engine intake air to flow through the cylinders of the engine. Furthermore, a delay in the response of the exhaust gas recirculation control valve is also caused by the throttling means provided in the vacuum passage for conducting vacuum from the vacuum port to the diaphragm chamber of the exhaust gas recirculation control valve and the throttling means provided in the recirculation passage for conducting exhaust gases from an exhaust gas takeout port provided in the exhaust passage to a back pressure chamber located upstream of the exhaust gas recirculation control valve. Therefore, in transient operational conditions such as acceleration or deceleration, changes of flow of exhaust gases are effected with a substantial delay relative to changes of flow of intake air. Such a delay in response causes no serious problem in acceleration, whereas in deceleration, particularly in abrupt deceleration, it causes a serious problem in that when the flow of intake air has already been decreased, a high exhaust gas pressure still exists in the back pressure chamber, whereby the vacuum control valve is maintained in such an operating condition as to hold a high vacuum in the vacuum passage for the diaphragm chamber of the exhaust gas recirculation control valve, while such a high vacuum in the vacuum passage is not immediately relieved through the vacuum port now located upstream of the fully closed throttle valve due to the throttling means provided at a middle portion of the vacuum passage. Therefore, in abrupt deceleration, a large amount of exhaust gases is recirculated to a very small amount of intake air, thereby causing misfiring of the internal combustion engine. Furthermore, when the exhaust gas recirculation control valve has been throttled to meet with the reduction of intake air flow after a time of delay in response, the engine is then abruptly restored to its normal operation, thereby causing forward jerking of the vehicle, which makes it less controllable. These problems become more serious, the higher is the exhaust gas recirculation ratio.

SUMMARY OF THE INVENTION

The object of the present invention is to obviate the aforementioned problems and to provide an improved exhaust gas recirculation system of the back pressure type wherein exhaust gas recirculation is immediately stopped when operation of the engine is altered to the decelerating mode.

In accordance with the present invention, the above-mentioned object is accomplished by an exhaust gas recirculation system for an internal combustion engine having an intake passage incorporating a throttle valve therein and an exhaust passage, comprising a recirculation passage for recirculating exhaust gases from said exhaust passage to said intake passage, an exhaust gas recirculation control valve provided at a middle portion of said recirculation passage, said control valve having a diaphragm chamber and being adapted to increase its opening in accordance with increase of vacuum supplied to said diaphragm chamber, a vacuum port provided in said intake passage so as to be located upstream of said throttle valve when it is fully closed and so as to be located downstream of said throttle valve when it is opened beyond a predetermined opening, a vacuum passage which connects said vacuum port and said diaphragm chamber of said exhaust gas recirculation control valve, a vacuum control valve provided at a middle portion of said vacuum passage and being adapted to control the vacuum conducted through said vacuum passage in accordance with the pressure of exhaust gases in said exhaust passage, and a relief valve for selectively opening said diaphragm chamber of said exhaust gas recirculation control valve to the atmosphere, said relief valve having a relief port for opening said diaphragm chamber of said exhaust gas recirculation control valve to the atmosphere, a diaphragm means including first and second diaphragm chambers and controlling said relief port, and a throttling passage which connects said first and second diaphragm chambers, said first diaphragm chamber being supplied with intake vacuum of the engine, wherein said diaphragm means opens said relief port when the vacuum in said first diaphragm chamber is greater than that in said second diaphragm chamber by more than a predetermined difference.

By this arrangement, in deceleration, for a moment following the start of deceleration, the vacuum in said first diaphragm chamber becomes greater than that in said second diaphragm chamber by more than the predetermined difference due to an abrupt increase of intake vacuum caused by abrupt closing of the throttle valve, whereby the diaphragm means of the relief valve opens the relief port so as to open the diaphragm chamber of the exhaust gas recirculation control valve to the atmosphere, and thus the exhaust gas recirculation control valve is immediately closed so as to shut down exhaust gas recirculation. After a lapse of a predetermined time which accomplishes equilibrium of the vacuum in said first and second diaphragm chambers through said throttling passage, the relief port is closed, thereby restoring normal operation of the exhaust gas recirculation control valve depending upon the vacuum controlled by the vacuum control valve so that exhaust gas recirculation is controlled in accordance with the principle of back pressure control.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2 and 3 are rather diagrammatical longitudinal sectional views of an embodiment of a composite valve which is desirably used in the exhaust gas recirculation system of the present invention, wherein FIG. 2 shows the valve in a first operating condition corresponding to normal or accelerating operation of the engine, while FIG. 3 shows the valve in a second operating condition corresponding to decelerating operation of the engine.

DESCRIPTION OF THE PREFERRED EMBODIMENT

Figure 1:
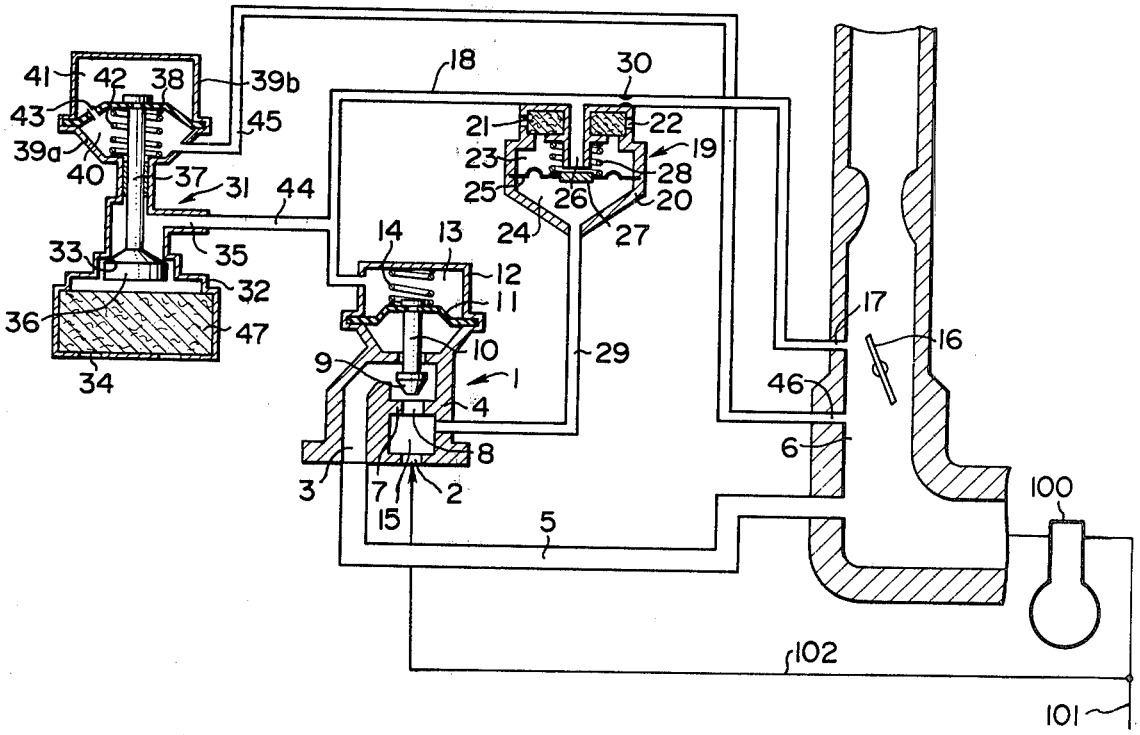
FIG. 1 is a diagrammatical view showing an embodiment of the exhaust gas recirculation system of the present invention.

Referring to FIG. 1, an exhaust gas recirculation control valve generally designated by 1 comprises a valve housing 4 having an inlet port 2 for receiving exhaust gases for recirculation from the exhaust passage 101 of an internal combustion engine 100 through a passage 102 and an outlet port 3 for discharging exhaust gases for recirculation to the intake passage 6 of the engine through a passage 5. The valve housing 4 further comprises a valve seat 7 which defines a valve port 8 provided between the inlet port 2 and the outlet port 3. The valve port 8 is controlled by a valve element 9 co-operating with the valve seat 7. The valve element 9 is supported by a stem 10 which in turn is supported by a diaphragm 11. Above the diaphragm 11 as seen in the figure is defined a diaphragm chamber 13 by the co-operation of the diaphragm 11 and a diaphragm cover 12. A compression coil spring 14 is provided in the diaphragm chamber 13 so as to exert a downward spring force as seen in the figure to the diaphragm 11 so that the valve element 9 is driven toward the valve seat 7 so as to close the valve port 8 by the spring force of the spring 14. The diaphragm chamber 13 is connected with a vacuum port 17 provided in the intake passage 6 by a vacuum passage 18. The vacuum port 17 is provided so as to be located upstream of a throttle valve 16 incorporated in the intake passage 6 when the throttle valve is fully closed and so as to be located downstream of the throttle valve when it is opened beyond a predetermined opening.

At a middle portion of the vacuum passage 18 is provided a vacuum control valve 19 which controls the vacuum conducted through the vacuum passage 18 from the vacuum port 19 to the diaphragm chamber 13 of the exhaust gas recirculation control valve 1. The vacuum control valve 19 has a housing 20 and a diaphragm 25 incorporated therein, whereby a relief chamber 23 is defined above the diaphragm as seen in the figure, while a diaphragm chamber 24 is defined below the diaphragm as seen in the figure. The diaphragm supports a valve element 27 which controls a valve port 26 connected with the vacuum passage 18. The valve element 27 is driven downward in the figure by a compression coil spring 28 so as to open the port 26. The relief chamber 23 is opened to the atmosphere through an air filter 21 and openings 22. When the pressure in the diaphragm chamber 24 is at atmospheric level, the valve element 27 is positioned as shown in FIG. 1 so that the valve port 26 communicates to the openings 22. On the other hand, when the pressure in the diaphragm chamber 24 rises beyond atmospheric pressure, the valve element 26 is shifted upward by the diaphragm 25 so as to close the valve port 26 thereby isolating the valve port 26 from the openings 22. The diaphragm chamber 24 is connected with a back pressure chamber 15 provided between the inlet port 2 and the valve port 7 of the exhaust gas recirculation control valve 1 by means of a passage 29, so that the diaphragm chamber 24 of the vacuum control valve 19 is provided with the pressure of exhaust gases existing in the back pressure chamber 15. At a middle portion of the vacuum passage 18 located between the vacuum port 17 and the vacuum control valve 19, is provided a throttling means 30.

The diaphragm chamber 13 of the exhaust gas recirculation control valve 1 is selectively opened to the atmosphere by a relief valve 31 which comprises a housing 32 having a relief port 33 controlled by a valve element 36 which is connected with a diaphragm 38 by a valve stem 37. Below the diaphragm 38 as seen in FIG. 1 is defined a first diaphragm chamber 40 by co-operation of the diaphragm 38 and a housing portion 39*a*, while a second diaphragm chamber 41 is defined above the diaphragm 38 by co-operation of the diaphragm 38 and a diaphragm cover 39*b*. The diaphragm 38 has a throttled opening 43 which connects said first and second diaphragm chambers 40 and 41. The diaphragm 38 is driven upward in the figure by a compression coil spring 42. When the valve element 36 is driven downward in the figure by the diaphragm 38 so as to open the port 33, a relief passage is established for the diaphragm chamber 13 of the exhaust gas recirculation control valve 1 through openings 34 provided in the housing 32 of the relief valve 31, an air filter 47 provided in the housing 32, the port 33, and a port 35 formed in the housing 32 for connection with the vacuum passage 18 by way of a passage 44. As shown in FIG. 1, it is desirable that the passage 44 is connected with the vacuum passage 18 at a portion located between the diaphragm chamber 13 and the throttling means 30. The first diaphragm chamber 40 of the relief valve 31 is connected with a vacuum port 46 provided in the intake passage 6 by way of a vacuum passage 45. The vacuum port 46 is located so as to be constantly positioned downstream of the throttle valve 16. The relief valve 31 is so designed that when the vacuum in said first diaphragm chamber 40 is greater than that in said second diaphragm chamber 41 by more than a predetermined difference the valve element 36 is driven downward in the figure so as to open the port 33.

The exhaust gas recirculation system shown in FIG. 1 operates as follows.

When the throttle valve 16 is not opened so much as to traverse the vacuum port 17, as in idling operation, no substantial vacuum is supplied to the port 17. Therefore, the exhaust gas recirculation control valve 1 is closed, whereby no exhaust gas recirculation is effected. When the throttle valve 16 is opened beyond the vacuum port 17 as shown in FIG. 1, the vacuum port is supplied with a substantial vacuum which is conducted through the vacuum passage 18 to the diaphragm chamber 13 of the exhaust gas recirculation control valve 1, while the vacuum which is actually supplied to the diaphragm chamber 13 is modified by the vacuum control valve 19. In this case, if the pressure of exhaust gases existing in the back pressure chamber 15 of the exhaust gas recirculation control valve is lower than a predetermined value, the diaphragm 25 of the vacuum control valve 19 is shifted downward in the figure by the compression coil spring 28 so that the valve element 27 opens the valve port 26, whereby the vacuum conducted through the vacuum port 17 toward the diaphragm chamber 13 of the exhaust gas recirculation control valve 1 is attenuated by the atmospheric air drawn into the vacuum passage through the valve port 26. Therefore, the vacuum actually supplied to the diaphragm chamber 13 is reduced so that the opening of the valve port 8 is correspondingly reduced, thereby raising the pressure of exhaust gases existing in the back pressure chamber 15. The increase of pressure of exhaust gases in the back pressure chamber 15 causes upward movement of the diaphragm 25 of the vacuum control valve 19 so as to reduce the opening of the valve port 26. This in turn reduces the attenuating effect applied to the vacuum conducted through the passage 18, and the vacuum actually supplied to the diaphragm chamber 13 of the exhaust gas recirculation control valve 1 is increased, whereby the diaphragm 11 is driven further upward in the figure, thereby increasing the opening of the valve port 8. By the increase of the opening of of the valve port 8 the pressure of exhaust gases in the back pressure chamber 15 correspondingly lowers, and this is reflected by an increase of the opening of the valve port 26 of the vacuum control valve 19, resulting in a corresponding reduction of the vacuum supplied to the diaphragm chamber 13 of the exhaust gas recirculation control valve 1. In this manner of feedback control, it is possible to maintain the pressure of exhaust gases in the back pressure chamber 15 substantially at atmospheric pressure. Therefore, by properly adjusting the throttling ratio of the port 2 relative to the flow resistance of the main exhaust passage of the engine, the ratio of exhaust gas recirculation is maintained at a predetermined constant value regardless of the flow of exhaust gases or the power output of the engine.

When the throttle valve 16 is rapidly opened for acceleration of the vehicle, the intake vacuum monitored by the vacuum port 46 reduces sharply, and therefore the relief port 31 is maintained in its closed condition, thereby isolating the vacuum passage 18 from the relief port, i.e. the openings 34.

When the throttle valve 16 is rapidly closed so as to decelerate the vehicle, the intake vacuum monitored by the vacuum port 46 rapidly increases to a very high level. This high vacuum is immediately supplied to the diaphragm chamber 40 of the relief valve 31 and the diaphragm 38 is driven downward in the figure so as to open the port 33. Therefore, the diaphragm chamber 13 of the exhaust gas recirculation control valve 1 is immediately open to the atmosphere and the diaphragm 11 is immediately driven downward in the figure by the spring 14 so as immediately to close the valve port 8, thereby immediately shutting down exhaust gas recirculation. After the lapse of a time determined by the throttling resistance of the opening 43, the vacuum difference between the diaphragm chambers 40 and 41 is removed, whereupon the diaphragm 38 is again driven upward in the figure by the compression coil spring 42 so as to close the port 33, thereby restoring the normal operating condition of the exhaust gas recirculation control system wherein the exhaust gas recirculation control valve 1 is controlled by the vacuum supplied from the vacuum port 17 and modified by the vacuum control valve 19.

Figure 3:
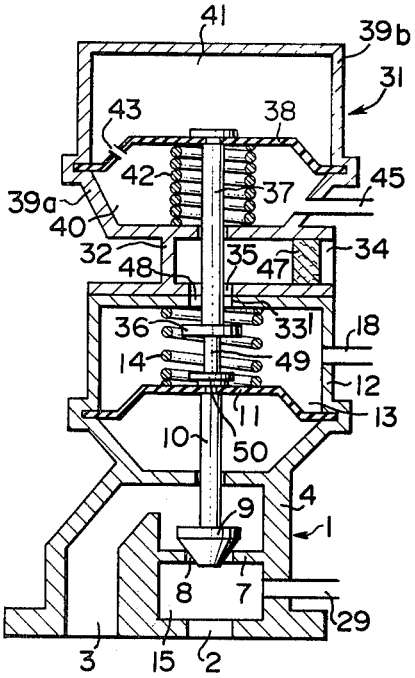
Figure 2:
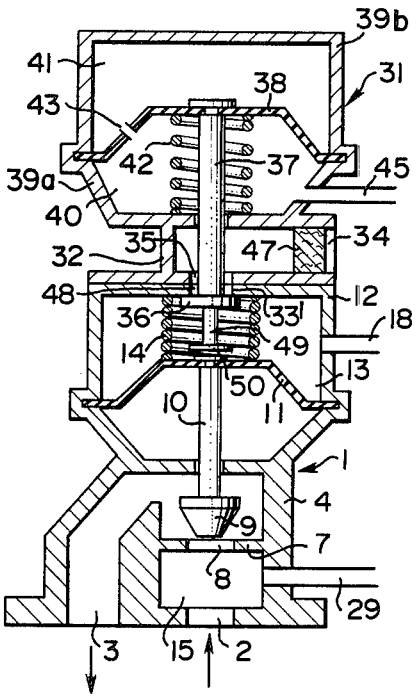

FIGS. 2 and 3 show an embodiment of a composite valve including the exhaust gas recirculation control valve 1 and the relief valve 31 in combination. Therefore in FIGS. 2 and 3 the portions corresponding to those shown in FIG. 1 are designated by the same reference numerals. In this composite valve, the valve housing 32 of the relief valve 31 is directly mounted onto the diaphragm cover 12 of the exhaust gas recirculation control valve 1. The port 35 of the relief valve 31 communicates directly to the diaphragm chamber 13 of the exhaust gas recirculation control valve 1 through a port 48 formed in the diaphragm cover 12. The valve element 36 of the relief valve 31 is located in the diaphragm chamber 13 and is adapted to co-operate with a valve seat portion 33' to control the through passage 35 and 48 which opens the diaphragm chamber 13 to the atmosphere through the air filter 47 and the opening 34. The valve element 36 is urged upward by the compression coil spring 42 and engages the valve seat portion 33' so as to close the port 48 as shown in FIG. 2 as long as the vacuum in the diaphragm chamber 40 is not greater than that in the diaphragm chamber 41 by more than a predetermined difference. The valve element 36 supports a rod 49 extended toward the diaphragm 11 and the rod 49 supports a push plate 50 at its lower end. When the valve element 36 is located to close the port 48 as shown in FIG. 2, the push plate 50 is located as raised from the diaphragm 11 so as not to interfere with the operation of the diaphragm.

It will be apparent that by substituting the composite valve as shown in FIGS. 2 and 3 for the exhaust gas recirculation control valve 1 and the relief valve 31 in the system shown in FIG. 1, the same control of exhaust gas recirculation is performed as explained before with reference to FIG. 1. In this connection, FIG. 3 shows the composite valve in the operating condition wherein the vacuum in the diaphragm chamber 40 is greater than that in the diaphragm chamber 41 by more than a predetermined difference due to abrupt supply of an increased intake vacuum to the diaphragm chamber 40, as in abrupt deceleration. In this operating condition, the valve element 36 is removed from the valve seat portion 33' thereby opening the diaphragm chamber 13 to the atmosphere through the open port 48, the air filter 47 and the air port 34. In this case, in accordance with the structure shown in FIGS. 2 and 3, the diaphragm 11 is driven downward in the figure not only by the compression coil spring 14 but also by the push plate 50 which is driven downward by the diaphragm 38 together with the valve element 36.

The composite valve as shown in FIGS. 2 and 3 eliminates the connecting passage 44 so that the diaphragm chamber 13 is more directly opened to the atmosphere in deceleration, whereby the quickness in shutting down exhaust gas recirculation in response to closing of the throttle valve is further improved. The mechanical inter-relation between the diaphragms 11 and 38 by the extension rod 49 and the push plate 50 also contributes to improving the response speed of the exhaust gas recirculation control valve in shutting down exhaust gas recirculation.

Although the invention has been shown and described with respect to some preferred embodiments thereof, it should be understood by those skilled in the art that various changes and omissions of the form and detail thereof may be made therein without departing from the scope of the invention.

I claim:

1. An exhaust gas recirculation system for an internal combustion engine having an intake passage incorporating a throttle valve therein and an exhaust passage, comprising a recirculation passage for recirculating exhaust gases from said exhaust passage to said intake passage, an exhaust gas recirculation control valve provided at a middle portion of said recirculation passage, said control valve having a diaphragm chamber and being adapted to increase its opening in accordance with increase of vacuum supplied to said diaphragm chamber, a vacuum port provided in said intake passage so as to be located upstream of said throttle valve when it is fully closed and so as to be located downstream of said throttle valve when it is opened beyond a predetermined opening, a vacuum passage which connects said vacuum port and said diaphragm chamber of said exhaust gas recirculation control valve, a vacuum control valve provided at a middle portion of said vacuum passage and being adapted to control the vacuum conducted through said vacuum passage in accordance with the pressure of exhaust gases in said recirculation passage, and a relief valve for selectively opening said diaphragm chamber of said exhaust gas recirculation control valve to the atmosphere, said relief valve having a relief port for opening said diaphragm chamber of said exhaust gas recirculation control valve to the atmosphere, a diaphragm means including first and second diaphragm chambers and controlling said relief port, and a throttling passage which connects said first and second diaphragm chambers, said first diaphragm chamber being supplied with intake vacuum of the engine, wherein said diaphragm means opens said relief port when the vacuuum in said first diaphragm chamber is greater than that in said second diaphragm chamber by more than a predetermined difference.

2. The exhaust gas recirculation system of claim 1, wherein said relief valve has a valve element which controls the opening of said relief port while said diaphragm means has a diaphragm which separates said first and second diaphragm chambers from each other, a valve stem which connects said diaphragm and said valve element, and a spring acting on said diaphragm to urge it in the direction to drive said valve element to the position to close said relief port.

3. The exhaust gas recirculation system of claim 2, wherein said throttling passage which connects said first and second diaphragm chambers of said relief port is a throttled opening formed in said diaphragm.

4. The exhaust gas recirculation system of claim 1, wherein said relief port is connected with said vacuum passage at a position located between said diaphragm chamber of said exhaust gas recirculation control valve and said vacuum control valve.

5. The exhaust gas recirculation system of claim 1, wherein said exhaust gas recirculation control valve and said relief valve are combined into a composite valve, said exhaust gas recirculation control valve having a housing portion which defines said diaphragm chamber thereof, said housing portion having an opening which serves as said relief port, said relief valve having a valve element operated by said diaphragm means of said relief valve, a diaphragm which separates said first and second diaphragm chambers from each other and a rod which connects said diaphragm and said valve element, said valve element controlling said opening formed in said housing portion of said exhaust gas recirculation control valve and serving as said relief port.

6. The exhaust gas recirculation system of claim 5, wherein said valve element is located within said diaphragm chamber of said exhaust gas recirculation control valve, said diaphragm means of said relief valve having a spring which urges said diaphragm of said relief valve in the direction to drive said valve element toward said opening serving as said relief port.

7. The exhaust gas recirculation system of claim 6, wherein said exhaust gas recirculation control valve has a diaphragm which defines said diaphragm chamber of said control valve, said valve element of said relief valve supporting a pushing means which engages said diaphragm of said exhaust gas recirculation control valve and pushes said diaphragm in the direction to close the opening of said exhaust gas recirculation control valve when the relief valve is opened with said valve element being driven away from said relief port.

* * * * *